US005242020A

United States Patent [19]

Cobern

[11] Patent Number: 5,242,020

[45] Date of Patent: Sep. 7, 1993

[54] METHOD FOR DEPLOYING EXTENDABLE ARM FOR FORMATION EVALUATION MWD TOOL

[75] Inventor: Martin E. Cobern, Cheshire, Conn.

[73] Assignee: Baker Hughes Incorporated, Houston, Tex.

[21] Appl. No.: 628,690

[22] Filed: Dec. 17, 1990

[51] Int. Cl.[5] ..... E21B 47/12

[52] U.S. Cl. ..... 166/250; 175/50

[58] Field of Search ..... 367/25, 911, 83-85; 181/102, 105; 166/250; 73/151, 152; 175/50; 324/366, 369, 367

[56] References Cited

U.S. PATENT DOCUMENTS

| | | | |
|---|---|---|---|
| 3,800,277 | 3/1974 | Patton et al. | 367/83 |
| 4,226,116 | 10/1980 | Denison | 73/151 |
| 4,716,973 | 1/1988 | Cobern | 166/250 |
| 4,881,406 | 11/1989 | Coury | 166/250 |

*Primary Examiner*—Ian J. Lobo

*Attorney, Agent, or Firm*—Fishman, Dionne & Cantor

[57] ABSTRACT

An extending arm is incorporated into a formation evaluation MWD collar or sub for extending outwardly from the tool and maintaining direct and continuous contact with the borehole wall (e.g., formation). In accordance with this invention, a method is presented for intermittently deploying the extendable arm and thereby decreasing drilling interference (caused by the arm) and avoiding the damage caused by accidents involving a nuclear source.

8 Claims, 6 Drawing Sheets

METHOD FOR DEPLOYING EXTENDABLE ARM FOR FORMATION EVALUATION MWD TOOL

CROSS-REFERENCE TO RELATED APPLICATION

This application is related to U.S. application Ser. No. 628,684, filed contemporaneously herewith entitled "Extendable Arm for Formation Evaluation MWD Tool" invented by Allen Duckworth, Carl A. Perry and Steven R. Rountree.

BACKGROUND OF THE INVENTION

This invention relates generally to borehole logging apparatus and methods for performing formation evaluation measurements. More particularly, this invention relates to a new and improved apparatus for effecting borehole formation evaluation, particularly nuclear logging, in real time wherein the improved formation evaluation apparatus comprises a measurement-while-drilling (MWD) tool.

Oil well logging has been known for many years and provides an oil and gas well driller with information about the particular earth formation being drilled. In conventional oil well logging, after a well has been drilled, a probe known as a sonde is lowered into the borehole and used to determine some characteristic of the formations which the well has traversed. The probe is typically a hermetically sealed steel cylinder which hangs at the end of a long cable which gives mechanical support to the sonde and provides power to the instrumentation inside the sonde. Such devices are known as wireline devices. The cable (which is attached to some sort of mobile laboratory at the surface) is also the means by which information is sent up to the surface. It thus becomes possible to measure some parameter of the earth's formations as a function of depth, that is, while the sonde is being pulled uphole. Such measurements are normally taken long after the actual drilling has taken place.

A sonde usually contains some type of source (nuclear, acoustic, or electrical) which transmits energy into the formation as well as a suitable receiver for detecting the same energy returning from the formation.

In certain formation evaluation tools, it is important to minimize the distance between the borehole wall and both the source (e.g., nuclear) and detector assemblies in the tool. For some tools, contact with the formation (i.e., borehole wall) is absolutely essential, and the quality of the measurement rapidly decreases with only a slight stand-off. For others, the reliability and/or quality of the measurement decreases with increasing stand-off, but some degree of stand-off is tolerable. This is particularly true when a measure of the stand-off is available, and the tool response can be compensated for the stand-off. Gamma-ray density tools and neutron porosity tools are examples of devices which utilize such techniques.

In order to provide contact between sensors and the formation, many of the prior art wireline formation evaluation tools are run with bow-springs. The bow-springs press the tool against one side of the borehole thereby minimizing the stand-off between the tool (sensors) and the formation face. In such cases, the sensors are mounted in the body of the tool. In other cases, tools are designed with arms, pads and mechanisms to extend the pads to the borehole wall; with the sensors being mounted in the pads. Examples of this type of prior art device are disclosed in U.S. Pat. Nos. 2,971,582 and 3,423,671.

More recently, formation evaluation tools for effecting logging in real time during drilling have become increasing popular. Such measurement-while-drilling (MWD) tools are subjected to much harsher and demanding operating conditions than prior art wireline devices. Thus, while the nuclear source and sensors in a formation evaluation MWD tool should have a minimal spacing between the tool and borehole wall as in wireline devices, it is far more difficult to effect such minimal spacing due to the restraints placed on a MWD tool.

SUMMARY OF THE INVENTION

In accordance with the present invention, an extending arm is incorporated into a formation evaluation MWD collar or sub for extending outwardly from the tool and maintaining direct and continuous contact with the borehole wall (i.e., formation). Significantly, the extending arm will maintain sensor contact with the formation wall while drilling. In the case of a nuclear logging MWD tool, the arm may contain a radioactive source and one or more radiation detector assemblies appropriate for the desired measurement.

A plurality of extending arms may be employed with each arm including sensors and detectors for particular types of formation evaluation. For example, three extending arms may be utilized for formation porosity evaluation (housing a neutron source and a pair of neutron detectors), formation density evaluation (a gamma-ray source and a pair of gamma-ray detectors) and formation resistivity measurements (a pair of electrodes).

In accordance with an important feature of one embodiment of this invention, the extending arm extends outwardly against the formation when the drilling fluid pumps are actuated; and the arm retracts when drilling mud circulation ceases. In a second embodiment of this invention, an electric or hydraulic motor may be utilized to extend and/or retract the arm during logging while tripping procedures.

In one embodiment of the present invention, the arm is linked to a longitudinally sliding sleeve so that upon actuation by the drilling mud pump, the sleeve will be urged downward whereupon the arm containing the instruments will extend laterally from the drill collar sub towards the borehole wall (and the formation).

In another and preferred embodiment of this invention, the arm is pivotably attached along its length to the drill collar sub so that upon actuation by the drilling mud pump, the arm will pivot angularly and outwardly from the drill collar sub towards the borehole wall. Rotation of the drill collar in a direction towards the hinge or pivot point of the arm will prevent jamming since the arm will always tend to close.

A method of intermittently deploying the extendable arm and thereby decreasing drilling interference (caused by the arm) and avoiding the damages caused by accidents involving the nuclear source is also provided.

The above-discussed and other features and advantages of the present invention will be appreciated and understood by those skilled in the art from the following detailed description and drawings.

BRIEF DESCRIPTION OF THE DRAWINGS

Referring now to the drawings, wherein like numbers are numbered alike in the several FIGURES.

DESCRIPTION OF THE PREFERRED EMBODIMENT

Figure 1:
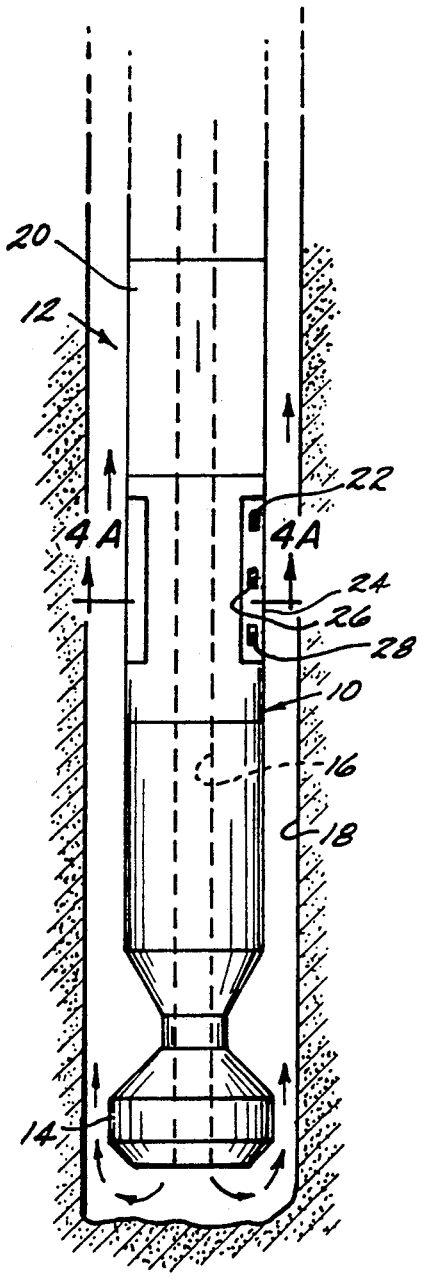
FIG. 1 is a side elevation view, partly in cross section, depicting a formation evaluation MWD sub having at least one extendable arm in accordance with the present invention.

Referring first to FIG. 1, a tool for formation evaluation and having at least one extendable arm is shown generally at 10. Tool 10 is associated with a measurement-while-drilling (MWD) system and comprises a subsection of a drillstring 12 which terminates at a drill bit 14. Drillstring 12 has an open internal diameter 16 in which drilling mud flows from the surface, through the drillstring and out of the drill bit. Drill cuttings produced by the operation of drill bit 14 are carried away by a mud stream rising up through the free annular space 18 between the drillstring and the wall of the well. The mud column in drillstring 12 may also serve as the transmission medium for carrying signals of downhole parameters to the surface. This signal transmission is accomplished by the well known technique of mud pulse generation whereby pressure pulses are generated in the mud column string in drillstring 12 representative of sensed parameters down the well. The drilling parameters are sensed in a sensor unit in a drill collar 20 near or adjacent to the drill bit. Pressure pulses are established in the mud stream within drillstring 12, and these pressure pulses are received by a pressure transducer and then transmitted to a signal receiving unit which may record, display and/or perform computations on the signals to provide information of various conditions down the well. The method and apparatus for this mud pulse telemetry is described in more detail in U.S. Pat. Nos. 3,982,431, 4,013,945 and 4,021,774, all of which are assigned to the assignee hereof and fully incorporated herein by reference.

The present invention finds utility in any formation evaluation measurement technique wherein it is desired to decrease the distance between the formation evaluation sensors and the formation (or borehole wall). The importance of having the sensors in close proximity to the formation is particularly important in neutron porosity and gamma-ray density formation evaluations tools. Tool 10 in FIG. 1 is representative of either one of these nuclear formation evaluation tools. Thus, a nuclear source (for emitting either neutrons or gamma rays) 22 is positioned on extendable arm 24. In addition, a near detector 26 and a far detector 28 are also positioned on extendable arm 24 in alignment with source 22.

Figure 2:
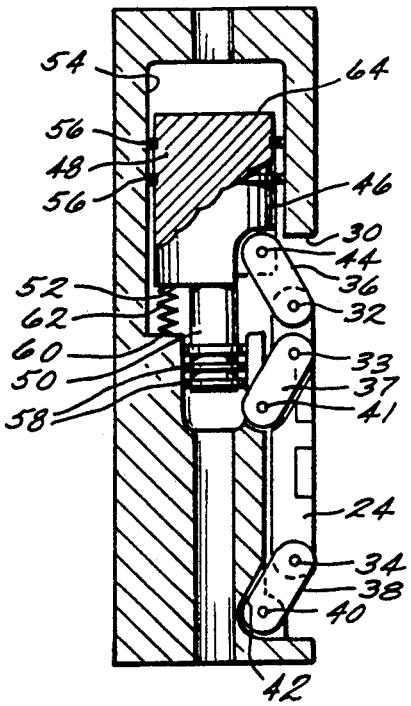
FIG. 2 is a cross sectional elevation view longitudinally through the MWD sub of FIG. 1 depicting a first embodiment of the present invention.

Turning now to FIG. 2, a mechanism for extending arm 24 towards the formation in a borehole in accordance with a first embodiment is shown. In this first embodiment, arm 24 is positioned in an opening 30 in tool 10. Arm 24 is pivotably attached at three respective pivots 32, 33 and 34 to an upper link 36, a middle link 37 and a lower link 38. In turn, lower link 38 and middle link 39 are pivotably attached at respective pivots 40 and 41 to an interior wall 42 of opening 30. Upper pivot 36 is pivotably connected at pivot pin 44 to a sleeve 46.

Sleeve 46 comprises an annular ring having a wider upper portion 48 and a narrower lower portion 50. A shoulder 52 defines the border between upper portion 48 and lower portion 50 of sleeve 46. Sleeve 46 is received in an interior chamber 54 within tool 10. Sleeve 46 is adapted for longitudinal sliding motion within tool 10 and is configured as a piston, with upper sliding seals 56 and lower sliding seals 58. Chamber 54 includes a shoulder 60 which is positioned so as to be in alignment with shoulder 52 of sleeve 46 when sleeve 46 is positioned in chamber 54. A spring 62 is located between shoulders 52 and 60 with spring 62 normally forcing sleeve 46 in an upward direction.

In accordance with the present invention, the formation evaluation tool 10 of FIG. 2 operates as follows. Upon actuation of the drilling fluid pump on the surface at the drill rig, drilling fluid is circulated through the inner diameter of tool 10 in the direction indicated by the arrows. Because of the restriction of flow occurring at the drill bit, pressure in the internal channel 16 then exceeds the pressure in the annulus 18. The upper face of the sleeve 46 is therefore exposed to a higher pressure than the lower surface which is open to the lower pressure in annulus 18, thereby forcing sleeve 46 downwardly. As sleeve 46 is forced downwardly, pivots 36 and 38 will be actuated urging arm 24 outwardly from tool 10 in a direction which is perpendicular to the longitudinal axis of tool 10. As arm 24 extends outwardly and laterally from tool 10, the gap between nuclear source 22, sensors 26, 28 and the formation will decrease until arm 24 actually contacts the formation, or reaches the limit of its travel. Simultaneously, spring 62 will be compressed. Of course, spring 62 is selected such that the force of the drilling mud will be greater than the upward force of spring 62 during pump circulation to permit downward movement of sleeve 46. When circulation of the drilling fluid ceases, the force urging sleeve 46 downwardly will also cease and spring 62 will then urge sleeve 46 upwardly thereby retracting extendable arm 24 into a position within opening 30 of tool 10.

Figure 3A:
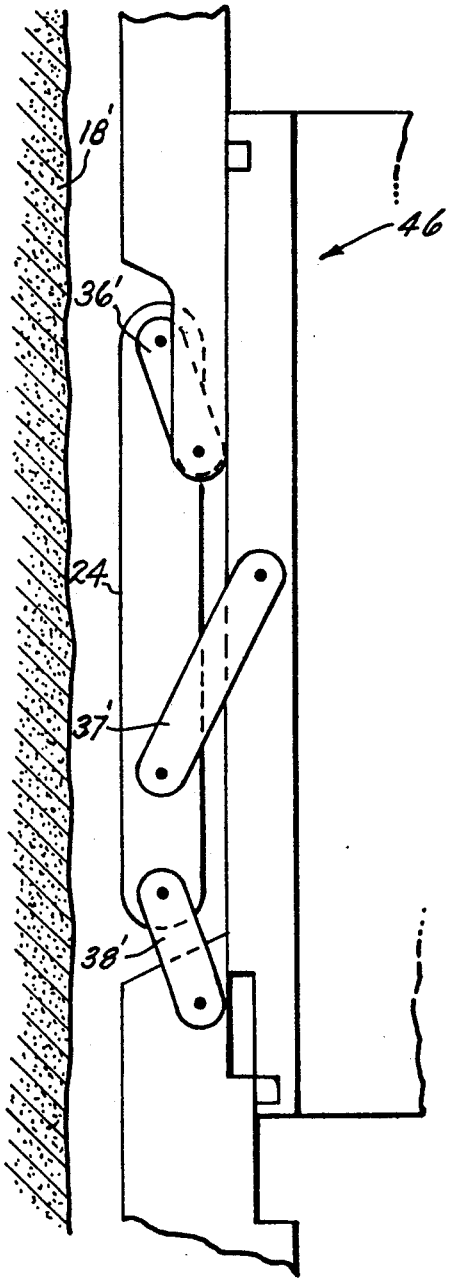
FIGS. 3A and 3B are side elevation schematic views, partly in cross-section, depicting an alternative linkage scheme for the MWD sub of FIG. 1 shown in respective retracted and extended positions.
Figure 3B:
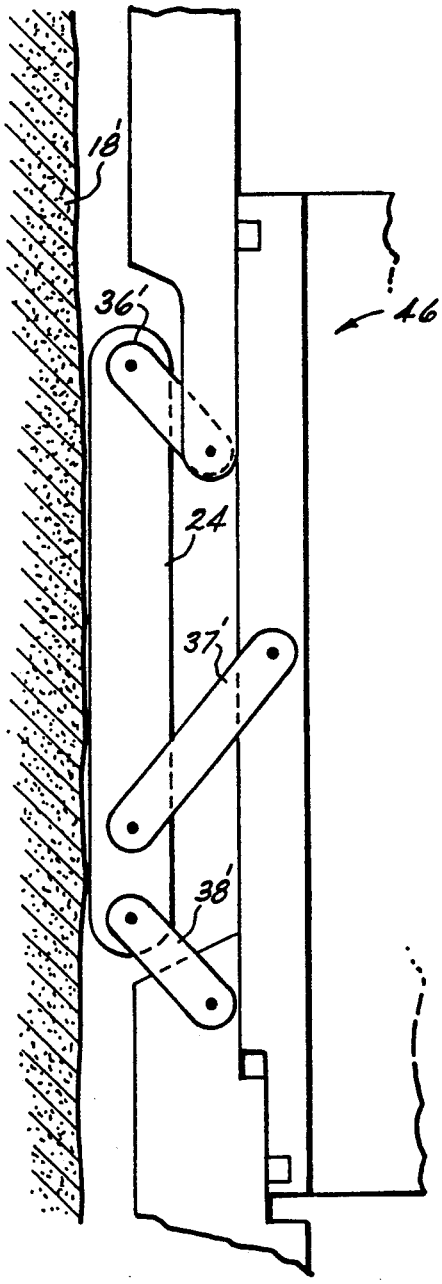

In an alternative link arrangement shown in FIGS. 3A and 3B, upper and lower links 36' and 38' are mutually parallel while middle link 37' is angularly offset from links 36', 38'. FIG. 3A depicts arm 24 in a retracted position while FIG. 3B depicts arm 24 in an extended position abutting formation 18'.

Preferably, each link 36, 37 and 38 is associated with a "float" mechanism which will allow arm 24 to float relative to the changing and uneven borehole wall as the drill collar 10 is rotated within the hole during drilling.

Figure 4B:
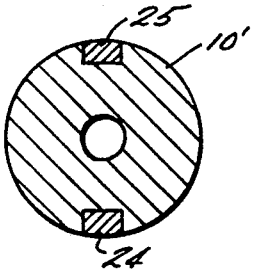
FIG. 4B is a cross-sectional elevation view, similar to FIG. 4A, but depicting an alternative embodiment.
Figure 4A:
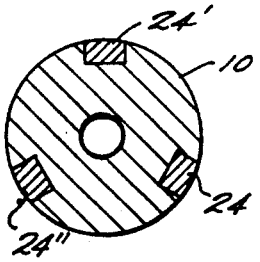
FIG. 4A is a longitudinal cross sectional view along the line 4A-4A of FIG. 1.

It will be appreciated that any number of extendable arms 24 may be utilized in conjunction with the present invention. For example, and as shown in FIG. 4A, in a typical application for use in formation evaluation, a tool may employ three distinct arms 24, 24' and 24" with one arm 24 housing a neutron source and neutron detectors for neutron porosity measurements, a second arm 24' housing a gamma-ray source and gamma-ray detectors for gamma-ray density measurements and a third arm 24" housing electrodes to facilitate a microresistivity measurement.

In still another embodiment, the arms may be positioned diametrically opposed from one another. Such a symmetrical arrangement is shown in FIG. 4B where a "dummy" arm 25 is positioned opposite arm 24 and thereby provides stabilization in the borehole. In addition, the extendable arms may be staggered with respect to one another longitudinally along the drill string.

Figure 5:
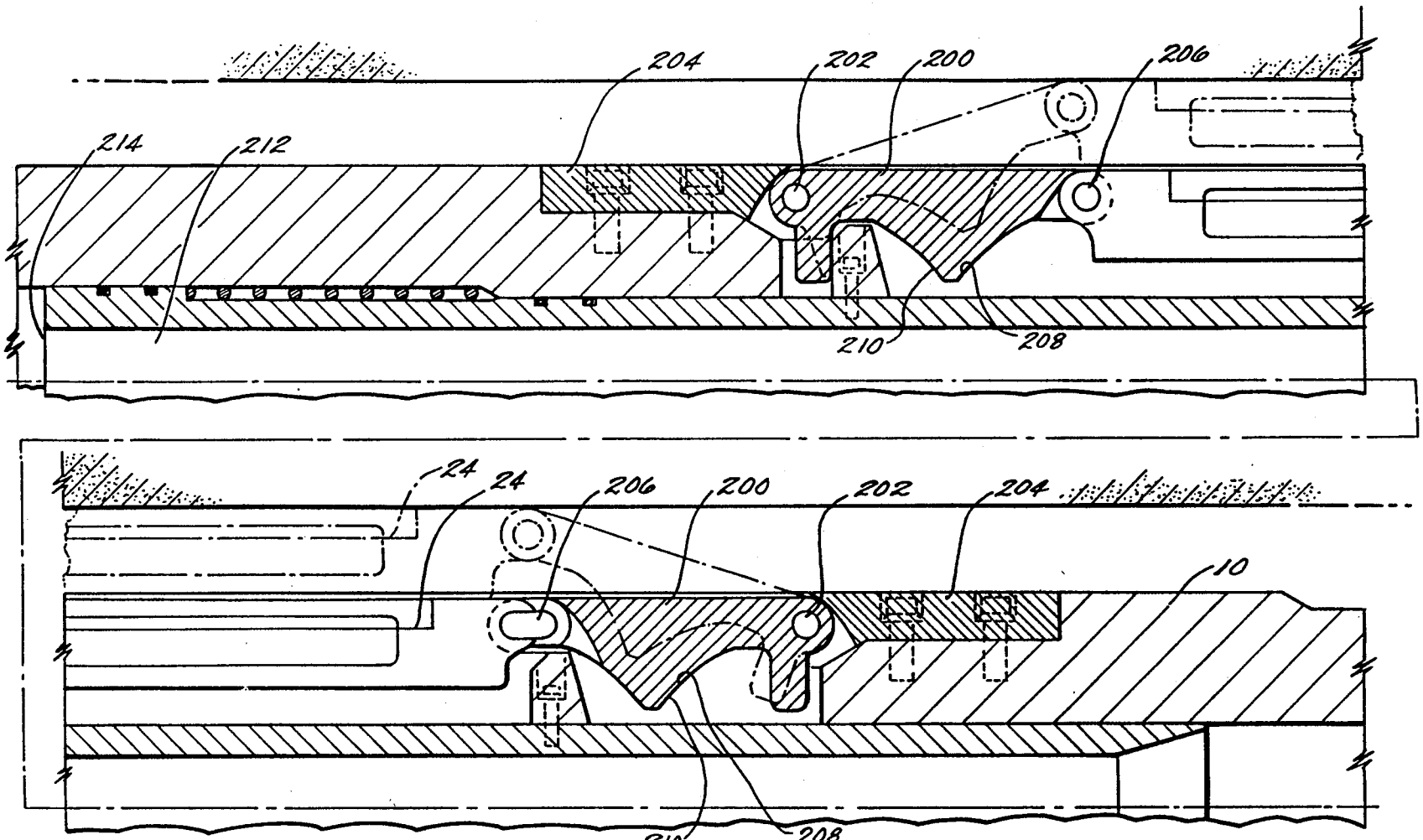
FIG. 5 is a longitudinal cross-sectional elevation view of still another alternative to the MWD sub of FIG. 1 which utilizes a camming mechanism for arm extension.

Turning now to FIG. 5, still another variant of the FIG. 1 embodiment is shown wherein the link assembly is replaced by a camming mechanism for urging the arm 24 outwardly and laterally from tool 10. It will be appreciated that arm 24 is shown retracted in the solid lines and extended in the dashed lines. The camming action is achieved by a pair of longitudinally displaced cams 200, each of which is pivotably attached at one end by pivots 206 to arm 24. The interior surface of each cam 200 included an inwardly facing wedge shaped first camming surface 208. In abutting contact with each first camming surface 208 is a second camming surface 210. Each second camming surface 210 is bolted and tied to a sleeve 212 which is structurally and functionally identical to sleeve 46 of FIG. 2. Thus, as drilling fluid is urged against upper surface 214 of sleeve 212, second camming surfaces 210 are urged downwardly sliding relative to stationary first camming surfaces 208. As this relative movement progresses, cams 200 are pivoted outwardly to the position shown in the dashed lines and thereby urge arm 24 (and sensors associated with arm 24) into contact with the borehole wall and formation.

Figure 6:
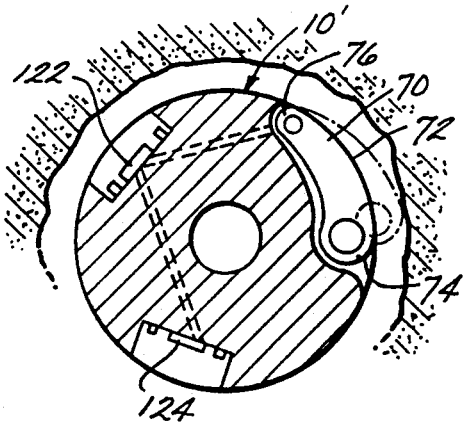
FIG. 6 is a cross sectional elevation view through a MWD sub showing a second embodiment of the present invention.
Figure 7:
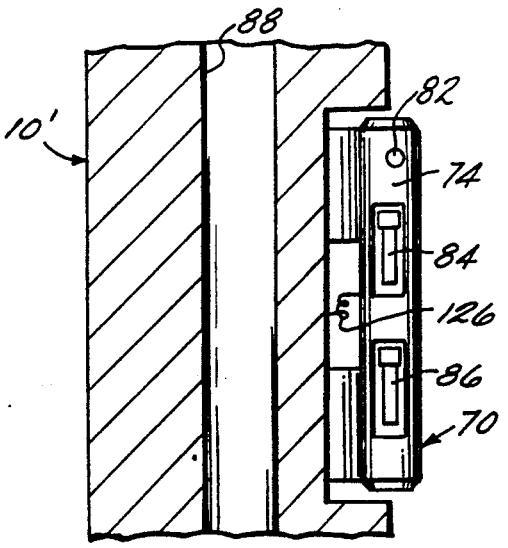
FIG. 7 is a side elevation view of the formation evaluation tool of FIG. 6.
Figure 8:
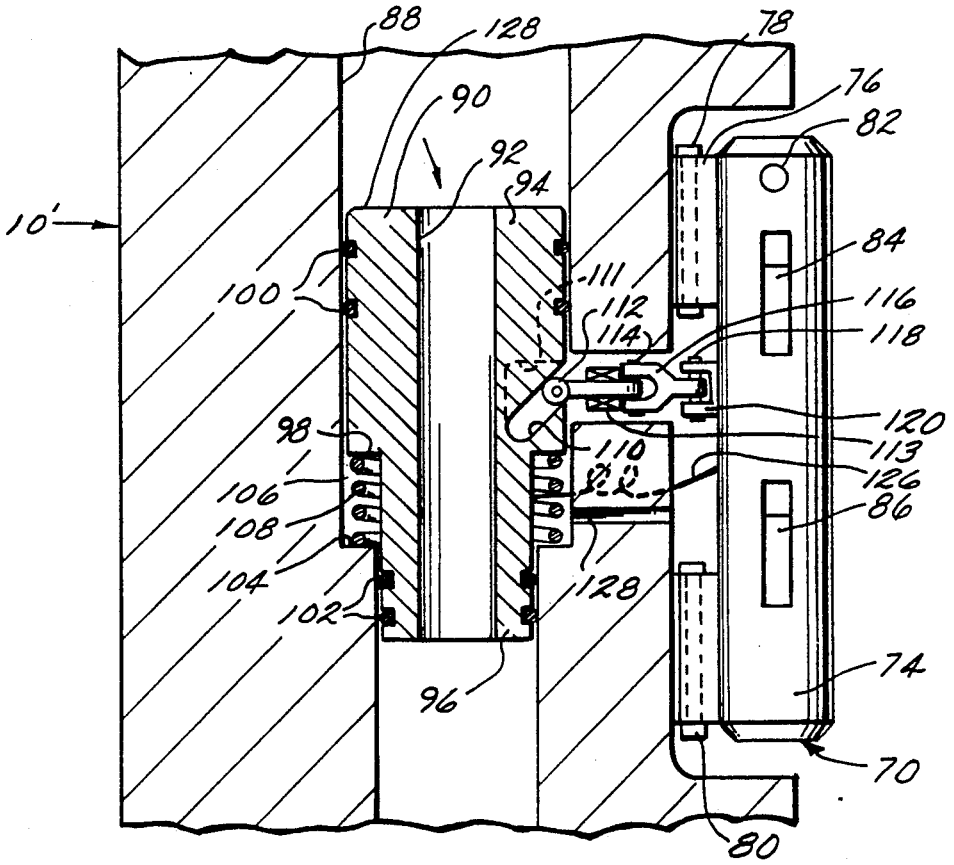
FIG. 8 is a cross sectional elevation view of the tool of FIG. 6 after the arm has been extended.

Turning now to FIGS. 6–8, a second embodiment of the present invention is shown generally at 10'. As in the previous embodiments, tool 101 provides a means for maintaining sensor contact with the formation wall while drilling; and is particularly advantageous for use in a gamma-ray density or neutron porosity tool. However, unlike the previous embodiments wherein the arm extends outwardly from the sub in a direction which is lateral to the longitudinal axis of the sub, in the embodiment of FIGS. 6–8, the arm extends in a generally tangential direction from the sub. Thus, sensor contact with the formation is accomplished using a hinged extending arm 70 having a semi-circular outer surface 72 so that in a closed position, tool 10' will maintain its circular perimeter. Arm 70 includes a wide portion 74 for housing the sensors. Wide portion 74 gradually decreases in width towards an opposite end at a narrow portion 76. As best shown in FIG. 8, narrow portion 76 includes a pair of openings which receive pins 78 and 80 for pivotable engagement to a corresponding pair of openings in the side wall of tool 10'. In this way, arm 70 pivots about pins 78 and 80 and tangentially extends between a closed position shown in the solid lines of FIG. 6 and an open position against the formation wall shown in the dashed lines of FIG. 6. In the particular embodiment described herein, arm 70 is suitable for use as either a gamma-ray density or neutron porosity tool and therefore includes a nuclear source 82 and a pair of scintillation detector assemblies, namely a near detector assembly 84 and a far detector assembly 86. Of course, it will be appreciated that extendable arm 70 may include other sensors for providing formation evaluation measurements such as spontaneous potential, microresistivity or a caliper log. Multipulse arms may also be used.

As in the first embodiments, the extending arm 70 of the second embodiment is actuated by the flowing of drilling mud through the center diameter 88 of tool 10'. This opening mechanism comprises a longitudinally sliding sleeve 90 which has a central opening 92 for the passage of drilling mud. Sleeve 90 is similar in configuration to sleeve 48 of FIG. 2 and therefore includes a large diameter section 94 and a smaller diameter section 96 with these two sections being demarcated by a shoulder 98. Sleeve 90 slides longitudinally within central cavity 88 and incorporates upper sliding seals 100 and lower sliding seals 102. Opening 88 also includes a shoulder 104 which is opposed to shoulder 98 to define an annulus 106. A spring 108 is provided in annulus 106 to bias sleeve 90 and urge sleeve 90 in an upward direction within central diameter 88.

Sleeve 90 includes a cam 110 which comprises a slot having an approximately 45° angle with respect to a plane transverse to the longitudinal axis of tool 10'. A cam follower 112 (associated with bearings 113) is provided in slot 110 and is pivotably connected (by a pair of openings) with a pin 114 to a link 116. In turn, link 116 is pivotably connected by a pin 118 to a hinge 120 attached to extendable arm 70. Detectors 84 and 86 within arm 70 are electrically connected to electronics located in tool 10', within for example, hatches 122 and 124 (see FIG. 6) preferably using a hairpin style tube 126. It will be appreciated that hairpin style tube 126 will house electrical wires which run between sensors 84, 86 and the electronics in hatches 122 and 124. A vent hole 128 extends through the wall of tool 10' so that cavity 106 communicates freely with the annular space 18 thus providing lubricating mud therein.

The extending arm mechanism of tool 10' operates as follows. Upon actuation of the mud pump on the surface at the drill rig, drilling mud flows downwardly in the direction indicated by the arrows in FIG. 8. The force of this mud against the upper flat surface 128 of sleeve 90 will urge sleeve 90 to slide downwardly and longitudinally along the central axis of tool 10' thereby compressing spring 108. As sleeve 90 is urged downwardly, cam 112 follower will move upwardly along the angled surface of cam 110 whereby the hinged link 116 will urge arm 70 from the closed position shown in FIG. 6 into the open position shown in the dashed lines of FIG. 6. Thus, the opening mechanism for extending arm 70 is actuated by the differential pressure between the bore 88 of tool 10' and the pressure in the annulus 18. Referring to FIG. 6, during rotary drilling wherein the drill string rotates in the direction indicated by the arrow, the arm 70 will pivot at a point close to the outside surface of the sub and will always tend to close upon collision with certain aberrations in the formation rather than jamming open. This is an important feature of the FIG. 6 embodiment. Of course, when drilling mud circulation ceases, previously biased spring 108 will urge sleeve 90 in an upward direction whereby cam 110 will urge cam 112 downwardly so that link 116 will pull arm 70 into a closed position.

In an alternative embodiment, slot 110 is enlarged to define a pocket 111 (as shown in the dashed lines) having a configuration which permits arm 70 to freely follow or track (e.g., float) the formation even when tool 10' is rotating in an eccentric manner. This alternative embodiment relies on centrifugal force to extend arm 70 while the sleeve assembly would still be used to retract the arm when mud flow ceases.

Figure 9:
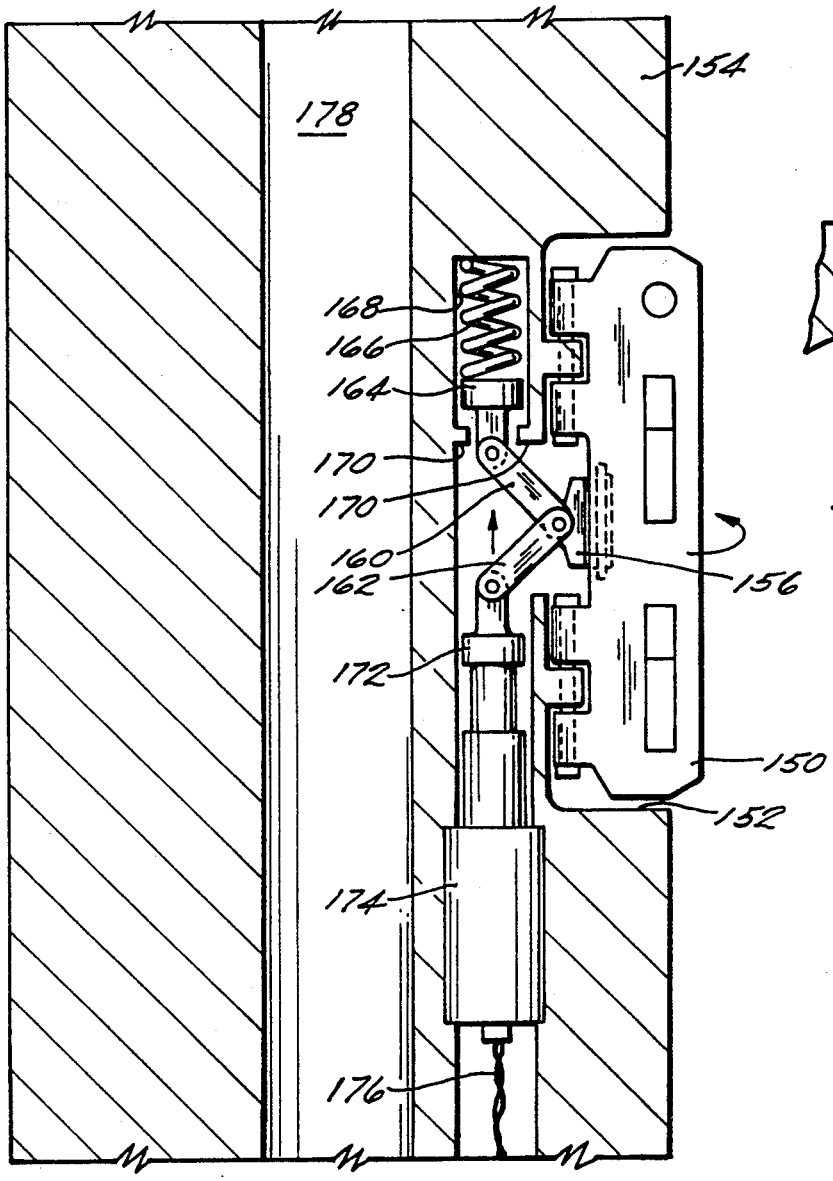
FIG. 9 is a cross-sectional elevation view of still another embodiment of this invention which employs a motor for actuating the extendable arm.
Figure 10:
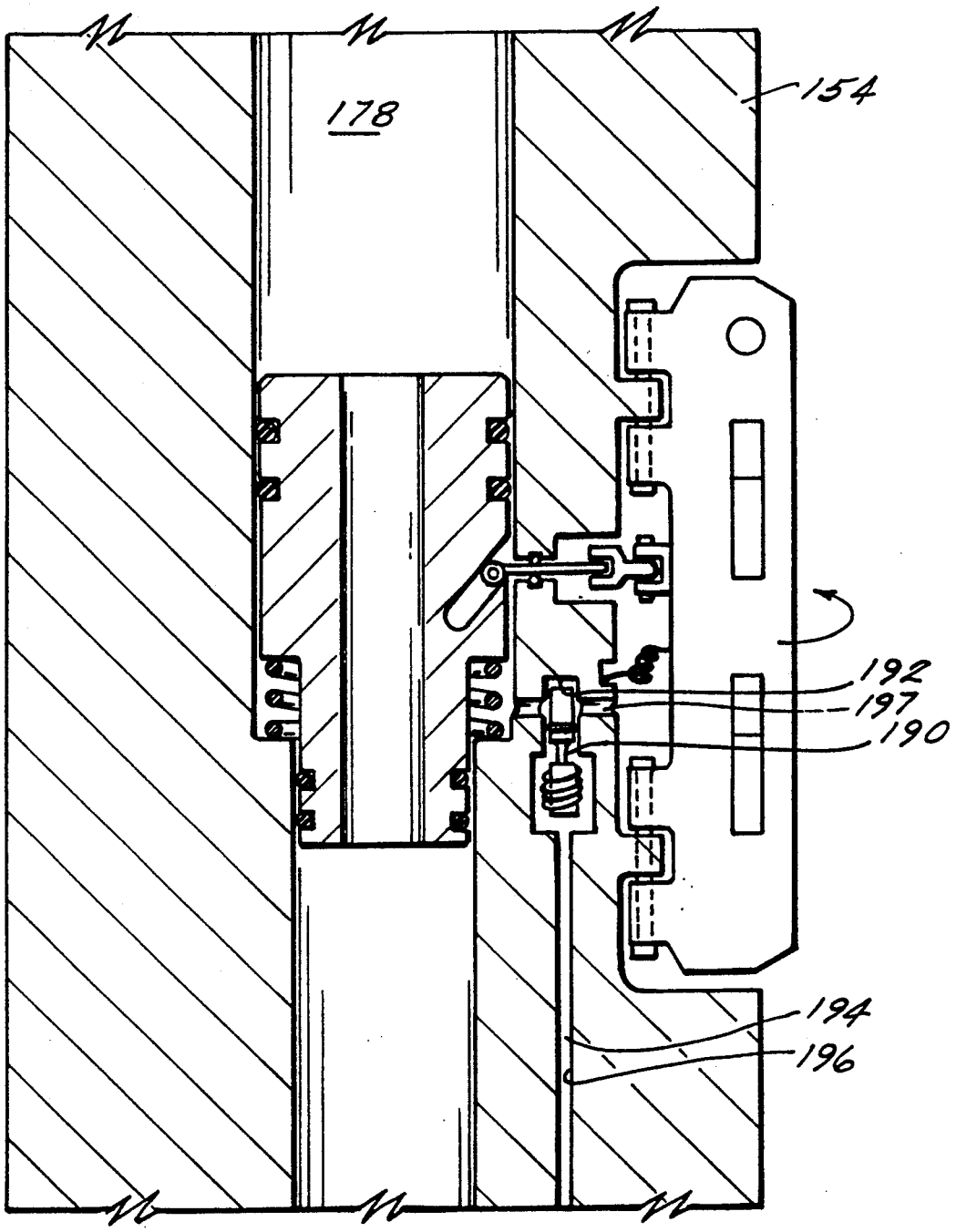
FIG. 10 is a cross-sectional elevation view of yet another embodiment of the present invention which employs a solenoid operated valve controlled at the surface for actuating the extendable arm.

It will be appreciated that continuous drilling with the extendable arm being deployed against the formation wall may interfere with drilling and may subject the sensor to unwanted wear. In addition, in the case of a nuclear source being located in the extendable arm (as is needed for neutron porosity or gamma-ray density measurement), there is an increased danger of an accident involving the nuclear source. Accordingly, in an important feature of the present invention, a method is provided for using the apparatus of either the FIG. 2, 5 or FIG. 7 embodiments intermittently and only when formation evaluation measurements are desired during the drilling process. This intermittent arm extension method is useful because formation evaluation information is more important in certain formations; and less important during other portions of the drilling process. This method requires an auxillary mechanism for extending the arm such as an electric or hydraulic motor. An example is shown in FIGS. 9 and 10 wherein two embodiments of the present invention are shown wherein arm extension is initiated by instructions sent from the surface. In FIG. 9, an electric actuator is utilized to extend and retract arm 24. In FIG. 10, mud flow is used as in previous embodiments with the addition of a solenoid-operated valve for locking the arm in a closed, retracted position.

Figure 9A:
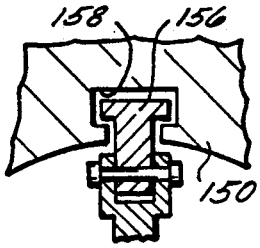
FIG. 9A is an enlarged cross-sectional detail of a portion of FIG. 9.

Turning now to a more detailed discussion of the embodiment of FIG. 9, an extendable arm 150 is hingedly mounted for radial movement from a retracted position within a recess 152 in drill string 154 and an extended position outwardly of drill string 154. A sliding shoe 156 is mounted in a T-shaped slot 158 (see FIG. 9A) with sliding shoe 156 being hingedly attached to a pair of scissor links 160, 162. Scissor link 160 is pivotably attached to a plunger 164 which is biased by a spring 166 in a channel 168. A pair of stops 170 prevent the relatively larger diameter head of plunger 164 from being pulled out of channel 168. Link 162 is pivotably attached to an extension member 172 of an electric actuator 174 which is wired for power and signal control at 176 to the MWD system (not shown). As will be discussed in more detail below, upon receiving instructions from the MWD system, the electric actuator 174 will urge extension member 172 upwardly as indicated by the arrow. Simultaneously, cushion spring 166 will urge plunger 164 downwardly so that sliding shoe 156 will be urged laterally of the drill string 154 as indicated by the arrow. This lateral movement will urge extendable arm 150 radially outwardly from drill string 154 with sliding shoe 156 moving within slot 158 as arm 150 undergoes such radial extension.

It will be clear from a review of FIG. 9 that unlike all of the previously described embodiments of the present invention, in the FIG. 9 embodiment, the mud flow through the interior section 178 of drill string 154 does not aid in the mechanism for extending arm 150 into contact with the formation.

Still another arm extension mechanism which allows the intermittent arm actuation method of this invention is shown in FIG. 10. The FIG. 10 embodiment is identical to the embodiment of FIG. 8 (and so the same identification numerals are used) with the important difference being the addition of solenoid operated valve 190 which opens (as shown in FIG. 10) to permit motion of the tracking arm and which closes to lock the tracking arm in position. In its closed position, the head of solenoid 190 engages a recess 192 having a complimentary contour. Leads 194 from solenoid 190 extend through a channel 196 to the MWD system. As will be discussed below, the operation of the solenoid is controlled by surface signals to the MWD system. Solenoid 190 seals off passage 197 from the fluid in annulus 19. This traps fluid 198 behind the (piston) sleeve 94. Since fluid can neither enter or leave this sealed cavity, sleeve 94 is unable to move, regardless of pressures and forces acting on it. The method of the present invention will now be discussed with the understanding that the arm actuating mechanism of FIGS. 9 and 10 would be used in accordance with this method.

In accordance with a first step of the method of the present invention, drilling takes place with the extendable arm retracted (in a closed position). Formation evaluation is executed with the arm in a closed position and the data therefrom is sent to the surface in real time using known MWD techniques. Because the arm is in a closed position, the data acquired may require significant borehole correction.

In a second step of the present invention and when the measurement-while-drilling data being received on the surface concerning the formation indicates that a reservoir or other zone of interest has been drilled, the drilling process is stopped. Next, the MWD tool (10 or 10') is signaled from the surface to extend the arm and place the pad in contact with the formation. Such surface signaling may be accomplished using several methods. For example, a sequence of starting and (stopping rotation of the drill string may be used to communicate from the well platform downhole so as to signal the extendable arm to open or close. Such a method is described in detail in U.S. Pat. No. 4,763,258 which is fully incorporated herein by reference. Alternatively, downhole communication from the rig floor to a mechanism for opening or closing the extendable arm (see FIGS. 9 or 10) can be accomplished by a preselected timed sequence of powering the MWD system up or down. This power cycling may be accomplished by operating the mud pump in an on/off sequence which would cause the MWD turbine (associated with the MWD electronics) to similarly be powered up or down. Also, modulation of the mud flow in a timed sequence will result in modulations to the MWD turbine with preselected modulations in the turbine resulting in a pattern of power modulations in the MWD system which will trigger the arm to open or close. This latter method of establishing a remote communications link from the rig floor downhole to the extendable arm is described in detail in U.S. patent application Ser. No. 389,321 filed Aug. 2, 1989 (now U.S. Pat. No. 5/034,929), which is assigned to the assignee hereof and fully incorporated herein by reference.

In the fourth step of the method of the present invention, the particular borehole section of interest is redrilled (reamed) with the arm in contact with the formation wall. "Rate of penetration" (ROP) and "rotations per minute" (RPM) are carefully controlled to give the best measurements and to minimize sensor damage. After the section of interest has been evaluated with the sensor in contact with the formation wall, the above described downhole communications link will send instructions for the arm to retract into a closed position. Thereafter, drilling is resumed with the arm in a closed position pending the encounter of another reservoir or other zone of interest wherein the above noted sequence will begin again.

The above described method provides accurate MWD formation data in certain zones of interests and less accurate, but quantative data throughout the borehole. The differences between the data taken in the zone of interest with the arm extended and retracted can be used to correct the data taken elsewhere with the arm retracted. Also, a mechanical or electrical measure of the arm extension may be used to provide a caliper log in the zone of interest. As previously mentioned, it will be appreciated that in practicing the method of this invention, an electric, hydraulic or other suitable mechanism (such as the solenoid operated valve of FIG. 10) is needed to move the sleeve (e.g., 48 or 90) longitudinally so as to open and/or retract the extendable arm.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of conducting formation evaluation while drilling a borehole using a formation evaluation tool having an extendable arm, the arm including at least one formation evaluation sensor, said arm being normally retracted and the arm extending outwardly toward the formation wall in response to instructions communicated from the surface downhole to the formation evaluation tool, including the steps of:

drilling the borehole with the arm retracted and acquiring formation evaluation data;

transmitting the acquired formation evaluation data to the surface;

stopping the borehole drilling when the transmitted data indicates a formation zone requiring accurate formation evaluation;

signalling said arm to extend outwardly toward the formation wall;

redrilling said formation zone with said arm in an extended position to obtain accurate formation evaluation;

signalling said arm to retract when formation evaluation of said zone is completed; and resuming drilling of the borehole with the arm retracted.

2. The method of claim 1 wherein said signalling step comprises a method of communicating instructions from a drill platform on the surface downhole to said formation evaluation tool including the steps of:

changing the state of a physical condition downhole in a predetermined time sequence, the state change being controlled from the drill platform at the surface;

detecting the state change and the predetermined timed sequence downhole; and converting the detected timed sequence of state change to instructions for the MWD system.

3. The method of claim 2 wherein the state change comprises changes in mud flow.

4. The method of claim 3 wherein said changes in mud flow are detected by turbine means associated with the MWD system.

5. The method of claim 4 wherein said changes in mud flow to the turbine means are responsive to changes in power to the MWD system.

6. The method of claim 4 wherein said timed sequence of state changes comprises ON/OFF powering to the MWD system by sequential start and stopping of mud flow to the turbine means.

7. The method of claim 4 wherein said timed sequence of state changes comprises modulated powering to the MWD system by modulating the flow of mud to the turbine means.

8. The method of claim 2 wherein the state change comprises:

a timed sequence of drillstring rotations.

* * * * *